US007672432B2

(12) United States Patent
Bosello

(10) Patent No.: US 7,672,432 B2
(45) Date of Patent: Mar. 2, 2010

(54) X-RAY MACHINE AND RELATED VOLTAGE GENERATOR

(75) Inventor: Aldo Bosello, Cardano Al Campo (IT)

(73) Assignee: Bosello High Technology S.r.l., Gallarate (va) (IT)

( * ) Notice: Subject to any disclaimer, the term of this patent is extended or adjusted under 35 U.S.C. 154(b) by 228 days.

(21) Appl. No.: 11/832,139

(22) Filed: Aug. 1, 2007

(65) Prior Publication Data

US 2008/0130834 A1 Jun. 5, 2008

(30) Foreign Application Priority Data

Aug. 8, 2006 (EP) ..... 06425578

(51) Int. Cl.
*H05G 1/10* (2006.01)
*H01J 19/50* (2006.01)

(52) U.S. Cl. ..... 378/101; 313/607

(58) Field of Classification Search ..... 378/91, 378/101–113; 250/427, 493.1, 496.1; 313/359.1, 313/271–292, 607; 323/304–317
See application file for complete search history.

(56) References Cited

U.S. PATENT DOCUMENTS 4,694,480 A 9/1987 Skillicorn
5,060,253 A 10/1991 Jedlitschka et al.
5,335,161 A * 8/1994 Pellegrino et al. ..... 363/61
5,563,569 A * 10/1996 Pellegrino et al. ..... 336/198
2006/0098778 A1 * 5/2006 Oettinger et al. ..... 378/101
2008/0107235 A1 * 5/2008 Sundaram ..... 378/101

FOREIGN PATENT DOCUMENTS

JP 2003257697 9/2003
SU 1111261 A * 8/1984

* cited by examiner

*Primary Examiner*—Edward J Glick
*Assistant Examiner*—Anastasia Midkiff
(74) *Attorney, Agent, or Firm*—Darby & Darby P.C.

(57) ABSTRACT

A voltage generator for an X-ray machine comprising an X-ray tube with a cathode and an anode is described. The voltage generator comprises a negative voltage multiplier for supplying a polarization voltage to the X-ray tube and a filament transformer which can be connected to the X-ray tube for supplying an energisation voltage to the X-ray tube. The voltage generator is characterized in that the negative voltage multiplier comprises a cavity able to house said filament transformer.

10 Claims, 6 Drawing Sheets

X-RAY MACHINE AND RELATED VOLTAGE GENERATOR

BACKGROUND OF THE INVENTION

1. Field of the Invention

The present invention relates to a voltage generator for X-ray machines and an X-ray machine which uses such a voltage generator.

2. Description of the Prior Art

As is known, an X-ray machine is an apparatus able to produce and emit an X-ray beam, namely a radiation having a wavelength of between about 0.1 and about 10 nm.

An X-ray machine typically comprises an X-ray tube for producing the X-ray beam and a generator for energizing the X-ray tube. The X-ray tube and the generator may be located inside separate metal containers connected by electric wires which allow the generator to energize the X-ray tube. Alternatively, the X-ray tube and the generator may be located inside a single metal container. In this case, reference is made to X-ray machines with a "single-piece" structure.

Typically, X-ray machines are used to perform non-invasive diagnoses (radiography, radioscopy, scintigraphy, etc.) of objects which comprise inside them a first portion made of a material which absorbs the X-rays and a second portion made of material through which the X-rays are able to pass. For example, in the medical field, the material which absorbs the X-rays may consist of the dense tissues of the human body (typically, bones or teeth) and the material through which the X-rays can pass may consist of the soft tissues of the human body.

In the industrial sector, X-rays machines may be used to carry out checks as to any flaws in a solid metal body (for example, a pipe or an engine block).

For this purpose, an X-ray beam is directed onto the body on which the check is to be performed. The beam part which strikes the first portion is absorbed, while the beam part which strikes the second portion passes through the body. The X-ray beam, upon leaving the body, therefore has a force distribution which substantially reproduces the internal structure of the body.

The X-ray beam leaving the body is then detected so as to create a visible image of the internal structure of the body. The detection may be performed, for example, by directing the beam leaving the body onto a photographic plate which is sensitive to X-rays or onto a screen treated with rare earths. Alternatively, the image may be acquired digitally by directing the beam leaving the body onto an array of semiconductor photosensors.

The digital acquisition of the images created by means of X-rays is currently of growing interest since it allows the images to be stored on a digital storage medium (floppy disk, hard disk, etc.). This advantageously allows the creation of very compact image files in which the images do not risk deteriorating with time, as instead occurs in the case of images recorded on a photographic plate.

The digital acquisition of images of objects analysed by means of X-ray machines requires X-rays beams emitted by particularly small focal spots with a particularly large amount of energy. This would require providing the X-ray machine with a generator able to produce a particularly high supply voltage, for example ranging between 20 kV and 450 kV.

However, the known generators able to produce such high voltages imply large dimensions. This results in an X-ray machine which is bulky, heavy and difficult to handle. Moreover, these generators are not suitable, on account of their size, for use in X-ray machines which have the abovementioned "single-piece" structure.

U.S. Pat. No. 5,060,253 discloses a high-voltage power supply wherein the second winding of the transformer, the capacitors, and the diodes of the rectifier and voltage-doubler circuits, are all disclosed in an enclosure made from two half-shells, whereas the primary winding and the magnetic circuit are disposed outside the enclosure.

U.S. Pat. No. 4,694,480 discloses a hand held x-ray source and an integral generator for exciting the tube.

SUMMARY OF THE INVENTION

Therefore, the object of the present invention is to provide a voltage generator for an X-ray machine which is able to produce the voltages required for the digital acquisition of images and which at the same time has a smaller volume than the known voltage generators able to produce these voltages.

These and other objects are achieved by a voltage generator according to claim 1 and by an X-ray machine according to claim 14. Further advantageous features are described in the respective dependent claims.

According to a first aspect, the present invention provides a voltage generator for an X-ray machine comprising an X-ray tube with a cathode and an anode. The voltage generator comprises a negative voltage multiplier for supplying a polarisation voltage to the X-ray tube and a filament transformer which can be connected to the X-ray tube for supplying an energisation voltage to the X-ray tube. The voltage generator is characterized by the fact that the negative voltage multiplier forms a first cavity, the first cavity housing the filament transformer.

Preferably, the voltage multiplier has a substantially tubular form and the first cavity is an axial cavity.

Preferably, the voltage multiplier is formed by a curved sheet of dielectric material. Preferably, an outer wall of the voltage multiplier is lined with a layer of insulating material.

Optionally, the voltage multiplier has a plurality of resistive elements and a plurality of capacitors fixed to the outer wall and substantially embedded in the layer of insulating material.

Preferably, the filament transformer comprises a ferromagnetic core with an elongated form having a straight longitudinal axis.

Preferably, the filament transformer comprises a first casing having a second cavity open at a first end and closed at a second end. The second cavity houses the core.

Advantageously, the first casing is made of dielectric material with an electrical insulation value greater than or equal to 20 kV per mm of thickness.

Preferably, the casing defines a first annular seat at the first end of the second cavity and a second annular seat at the second end of the second cavity. The first and the second annular seats are preferably coaxial with the second cavity. The first annular seat houses a primary winding and the second annular seat houses a secondary winding.

Preferably, the second annular seat is arranged so that the secondary winding is situated at a certain distance from the end of the first casing.

Preferably, a closed bottom of the second cavity and an external wall of the first casing define a substantially cylindrical third cavity.

Advantageously, the voltage generator comprises a cover which is inserted into the first casing so as to cover the second annular seat. Preferably, the cover has a cylindrical shank inserted precisely inside the substantially cylindrical third cavity, and a ring with a diameter greater than the diameter of the cylindrical shank.

According to a second aspect, the present invention provides an X-ray machine comprising an X-ray tube and a voltage generator. The X-ray machine is characterized in that the voltage generator is a voltage generator in accordance with that described above. Preferably, the voltage generator and the X-ray tube are housed inside a same second casing.

The present invention will become fully clear after reading the following detailed description, with reference to the attached sheets of drawings.

DETAILED DESCRIPTION

Figure 1:
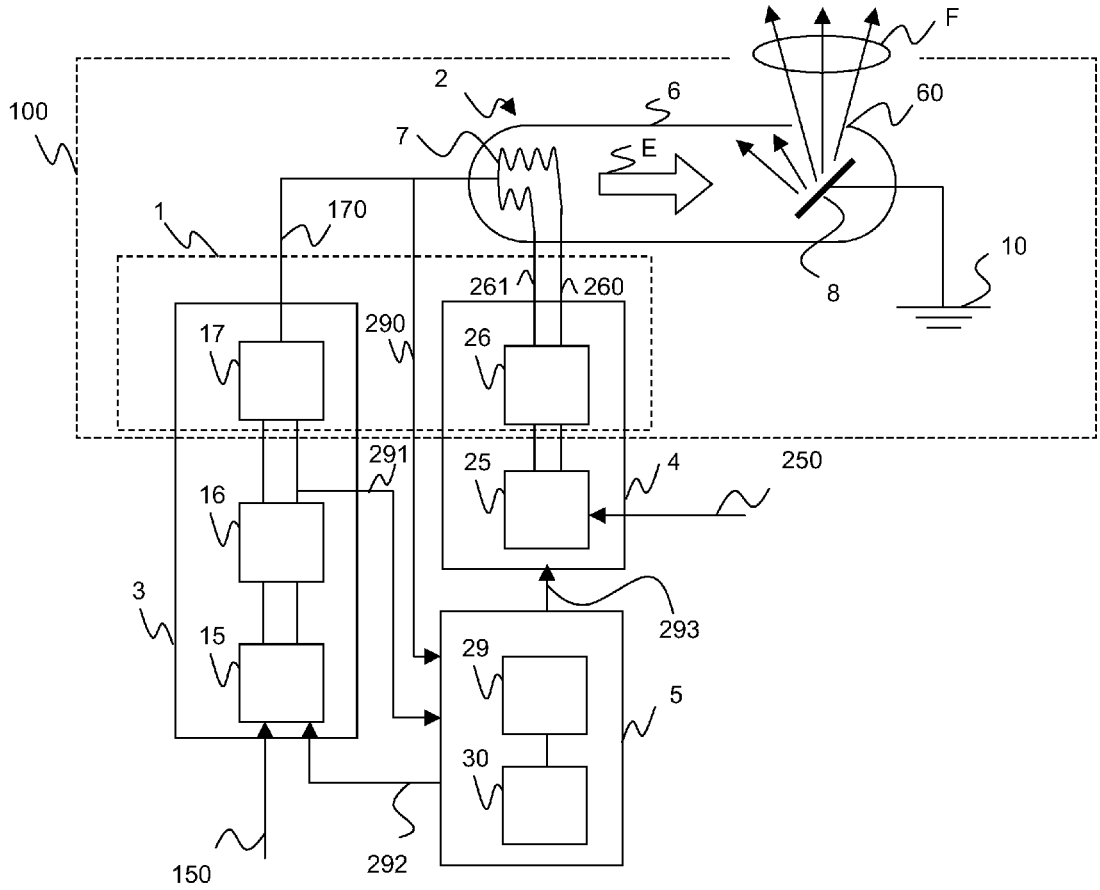
FIG. 1 shows schematically a block diagram of a first example of an X-ray machine.

FIG. 1 shows schematically a block diagram of a first example of an X-ray machine 100. The X-ray machine 100 comprises an X-ray tube 2, a voltage generator 1 and a regulating unit 5.

The X-ray tube 2 comprises a substantially cylindrical casing 2 inside which a cathode 7 and an anode 8 are housed. The casing 6 is made of a material which absorbs the X-rays. A window 60, however, is provided in the vicinity of the anode 8. The window 60 is open or is made of a material which is substantially able to be passed through by the X-rays so as to allow an X-ray beam F to pass out. The X-rays which do not pass out from the casing are generally called "rebound" rays.

The cathode 7 according to FIG. 1 comprises a filament (or focal spot) made of metal. However, in embodiments not shown in the drawings, the cathode 7 may comprise several metal filaments (or focal spots) which allow the X-ray tube to produce X-ray beams F with an emission of varying intensity. The latter determines different definition of the images. The anode 8 comprises a target preferably made of high density metal, such as tungsten or molybdenum for example. The anode 8 is inclined relative to the axis of the X-ray tube 6 at a certain angle, for reasons which will be explained in greater detail below.

In the X-ray machine 100, the cathode 7 is electrically connected to a voltage generator 1, while the anode 8 is connected to earth 10.

The voltage generator 1 comprises a negative voltage multiplier 17 and a filament transformer 26. The negative voltage multiplier 17 forms part of a first power supply circuit 3 and the filament transformer 26 forms part of a second power supply circuit 4.

The first power supply circuit 3 comprises a first switching power supplier 15, an operating transformer 16 and the negative voltage multiplier 17 connected in cascade. An input 150 of the first switching power supplier 15 is connected to an electric power source, for example the electric mains (not shown in FIG. 1). An output 170 of the negative voltage multiplier 17 is connected to the cathode 7. According to an alternative embodiment, the operating transformer 16 is a component outside the generator 1. The manufacturer is therefore not obliged to reduce the dimensions of the operating transformer 16 (or modify its form) in order to incorporate it in the generator 1.

The second power supply circuit 4 comprises a second switching power supplier 25 and the filament transformer 26 connected in cascade. An input 250 of the second switching power supplier 25 is connected to an electric power source, for example the electric mains (not shown in FIG. 1). Two outputs 260, 261 of the filament transformer 26 are each connected to a respective end of the cathode 7.

The regulating unit 5 comprises a sensor device 29 and a control circuit 30. The sensor device 29 has two inputs 290, 291 connected to the output 170 of the negative voltage multiplier 17 and to an input of the negative voltage multiplier 17. Moreover, the sensor device 29 has two outputs 292, 293 connected to the first switching power supplier 15 and to the second switching power supplier 25, respectively.

Operation of the X-ray machine 100 shown in FIG. 1 will now be briefly described.

The first power supply circuit 3 draws the line voltage (230 V) via the input 150 from the power line, converts it into a negative polarisation voltage Vpol and supplies it via the output 170 to the cathode 7, so as to create a voltage difference Vpol between the cathode 7 and the anode 8. Preferably, the polarisation voltage Vpol has an absolute value of between 20 kV and 300 kV, for example 160 kV.

Similarly, the second power supply circuit 4 draws the line voltage (230 V) via the input 250 from the power line, converts it into an energisation voltage Von and supplies it via the outputs 260, 261 to the cathode 7 so as to create a voltage difference Von at the terminals of the filament included in the cathode 7. In this way, an energisation current Ion flows in the filament of the cathode 7. Preferably, the energisation voltage Von is between 3 V and 10 V, for example 4 V.

When the energisation voltage Von is applied to the cathode 7, a plurality of electrons E is extracted from the cathode 7 owing to the thermoionic effect. The electrons E, once extracted from the cathode 7, are accelerated in the axial direction as a result of the polarisation voltage Vpol between the cathode 7 and the anode 8. They then travel along the tube 2 in the axial direction until they collide with the anode 8. As a result of the collision, the electrons contained in the anode 8 perform a transition from a higher energy level to a lower energy level, thus emitting a plurality of photons. Of these photons, those emitted in a direction such as to be able to pass out of the tube 2 through the window 60 of the casing 6 form the X-ray beam F.

The regulating unit 5 allows detection of the polarisation voltage Vpol and an anode current Ipol, namely the current associated with the electrons E which travel along the tube 2.

On the basis of these values detected, the regulating unit 5 performs feedback control of the operation of the first switching power supplier 15 and second switching power supplier 25, so as to keep the voltage and current values detected stable. A detailed description of operation of the regulating unit is omitted since not useful for the purposes of the present invention.

As already mentioned, according to the present invention an X-ray machine comprising a particularly compact generator able to produce the polarisation voltages Vpol mentioned above is provided.

In particular, the Applicant has noted that a particularly compact generator may be obtained by designing the structure of the negative voltage multiplier 17 so that the latter has a cavity able to house the filament transformer 26. Conveniently the structure of the filament transformer 26 is designed so that the latter has a substantially straight form.

More particularly, with reference to FIGS. 2, 3 and 4, the structure of the filament transformer 26 according to an embodiment of the present invention will now be explained.

The filament transformer 26 comprises a core 31 and a casing 32. The core 31 has preferably an elongated form with a straight longitudinal (for example cylindrical or prismatic) axis and comprises a ferromagnetic material, such as ferrite for example. Conveniently, the core is housed inside a special cavity 33. The cavity 33 is open at one of its ends (in order to introduce the core) and closed at the opposite end. In this way, the casing 32 defines an annular thickness between its outer surface 32*a* and the surface of the cavity 33.

A first annular seat 36, which is coaxial with the cavity 33, is formed in the annular thickness of the casing, at the open end of the cavity 33.

A second annular seat 37, which is coaxial with the cavity 33, is formed in the annular thickness of the casing, at the closed end of the cavity 33.

Figure 2:
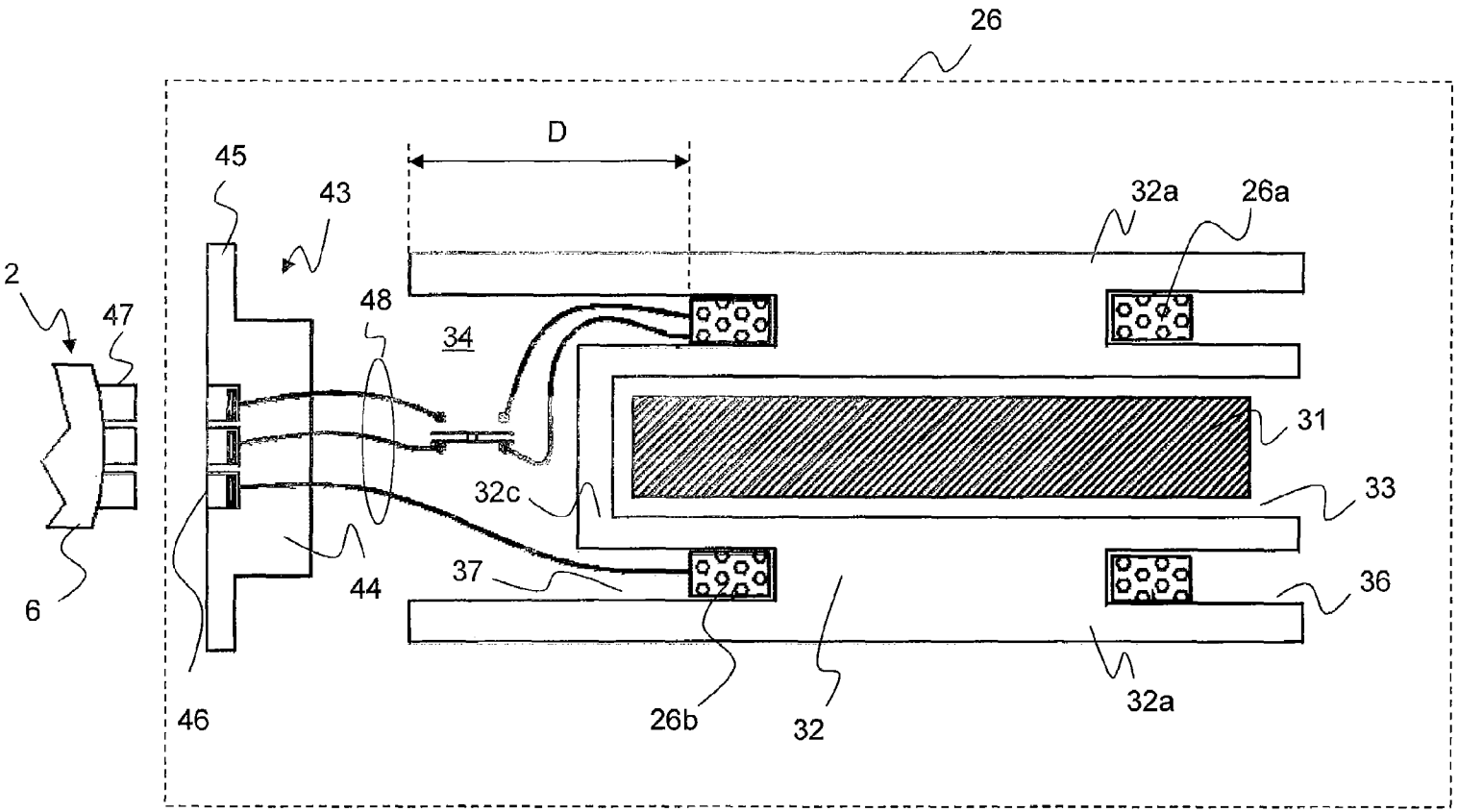
FIG. 2 shows a schematic longitudinally sectioned view of a filament transformer according to an embodiment of the present invention.

The closed bottom 32*c* of the cavity 33 is inset with respect to the outer wall of the casing, as shown in FIG. 2, for reasons which will be explained below. In other words a cylindrical cavity 34 is formed between the closed bottom 32*c* and the walls of the casing 32. Moreover, as shown in FIG. 2, the bottom of the second annular seat 37 is further inset with respect to the closed bottom 32*c* of the cavity 33. In this way, the bottom of the second annular seat 37 is situated at a certain distance from the end of the casing 32.

The first annular seat 36 is able to house the primary winding 26*a* of the filament transformer 26. The second annular seat 37 is able to house the secondary winding 26*b* of the filament transformer 26. Conveniently, the secondary winding 26*b* is arranged at a certain distance D from the end of the casing (FIG. 2).

The casing 32 is preferably made of dielectric material with a high dielectric rigidity and flame-resistance, such as, for example, polytetrafluoroethylene (PTFE), PVC or similar materials. Conveniently, the material of the casing 32 has a minimum electrical insulation value of 20 kV per mm of thickness. Therefore, the core 31 is electrically insulated both from the primary winding 26*a* and from the secondary winding 26*b*. The primary winding 26*a* and the secondary winding 26*b* are also advantageously insulated from the exterior. Moreover, since the secondary winding 26*b* is arranged at a certain distance D from the end of the casing 32, the danger of discharges from the secondary winding 26*b* outside the casing 32 is greatly reduced.

Optionally, the core 31 and the windings 26*a*, 26*b* may be embedded in resin so as to form a body with a substantially cylindrical or prismatic shape.

The filament transformer 26 is also provided with a cover 43 which can be inserted into the casing 32 so as to cover the second annular seat 37. Conveniently, the cover 43 has a cylindrical shank 44 able to be inserted precisely (with or without interference) inside the cylindrical cavity 34. The cover 43 also has a ring 45 with a diameter greater than that of the cylindrical shank 44, preferably corresponding to the external diameter of the casing 32.

Conveniently, when the cover 43 is inserted in the casing 32, the shank 44 remains at a distance from the base 32*c*.

Preferably, the cover 43 is made of insulating material, more preferably of the same insulating material used for the casing 32.

In the embodiment described, the cover 43 is also provided with an electrical fastening and connection device 46. Preferably the electrical fastening and connection device 46 comprises engaging holes formed on an outer surface of the cover 43. The engaging holes 46 are electrically connected to the terminals of the secondary winding 26*b* via electrodes 48.

As shown in FIG. 2, according to an embodiment of the present invention, the casing 6 of the X-ray tube 2 is advantageously provided, at its end which contains the cathode 7, with connection pins 47 able to engage inside the engaging holes of the cover 43. When the connection pins 47 engage inside the engaging holes of the cover 43, the ends of the cathode 7 are each electrically connected to a respective terminal of the secondary winding 26*a* of the filament transformer 26, as schematically shown in the block diagram of FIG. 1 (outputs 260 and 261 of the filament transformer 26).

In this way, the X-ray tube 2 is advantageously fitted directly onto the cover 43 of the filament transformer 26, without the need for further connection leads or external supports.

Figure 5:
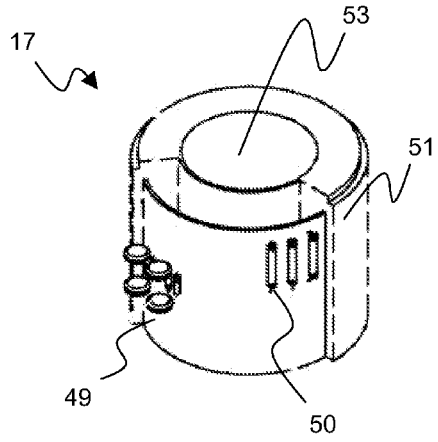
FIG. 5 is a perspective view of a voltage multiplier according to an embodiment of the present invention.

With reference to FIG. 5, the structure of the negative voltage multiplier 17 shown in FIG. 1, according to an embodiment of the present invention, will now be described.

As shown in FIG. 5, the voltage multiplier 17 comprises a support structure 17 with a substantially tubular shape. In particular the support structure 51 is preferably formed by a sheet of dielectric material rolled so as form a through-cavity 53. The voltage multiplier 17 also comprises a plurality of capacitors 49 and a plurality of resistive elements 50, such as resistors or diodes, which are fixed to the outer surface of the support structure 51. Preferably the outer surface of the support structure is lined with a layer of insulating material, for example a resin, with a thickness such that the plurality of capacitors 49 and the plurality of resistive elements 50 are substantially embedded in the layer of insulating material.

Figure 6:
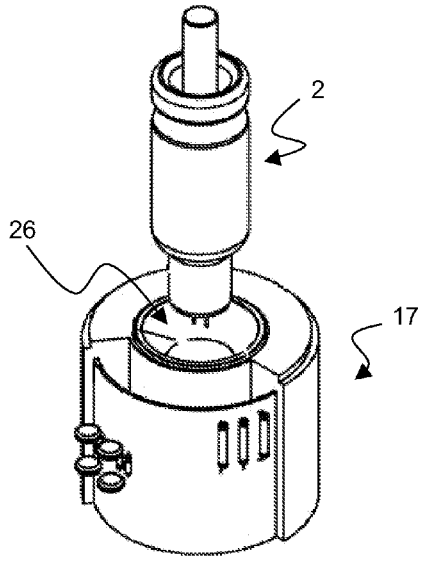
FIG. 6 is a perspective view of an X-ray tube, the filament transformer according to FIGS. 2, 3 and 4 and the voltage multiplier according to FIG. 5 assembled in an operative configuration so as to form part of the X-ray machine according to FIG. 1.

FIG. 6 shows the X-ray tube 2, the filament transformer 26 and the negative voltage multiplier 17 while they are assembled in their operative configuration.

Figure 4:
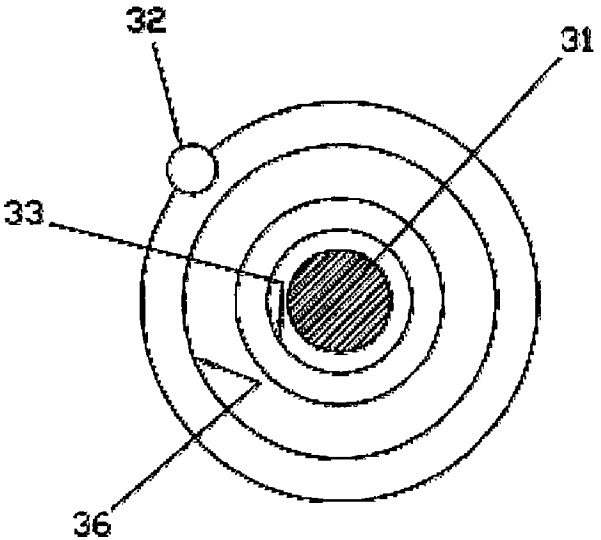
FIG. 4 shows a rear view of the filament transformer according to FIG. 2.
Figure 3:
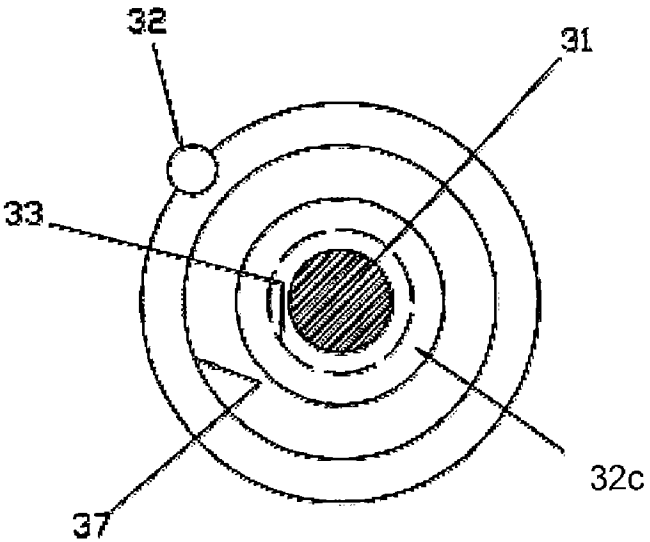
FIG. 3 shows a front view of the filament transformer according to FIG. 2.

As shown in FIG. 6, the filament transformer 26, the structure of which was described in detail with reference to FIGS. 2, 3 and 4, is housed inside the through-cavity 53 of the support structure 51 of the voltage multiplier 17. The X-ray tube 2 is then fixed, by means of the electrical fastening and connection means 46 of the cover 43 described with reference to FIG. 2, to the transformer 17, said X-ray tube therefore projecting in the axial direction from the through-hole 53 of the voltage multiplier 17.

Moreover, by means of an electrical connection not shown, the voltage multiplier 17 is also connected to a connection pin 47 of the X-ray tube 2 so as to supply to the cathode 7 of the X-ray tube 2 the polarisation voltage Vpol (connection 170 shown in FIG. 1).

Therefore, advantageously, according to the present invention, the negative voltage multiplier 17, the filament transformer 26 and the X-ray tube 2 form an extremely compact unit which allows the overall dimensions of the generator 1 to be reduced considerably.

Figure 7:
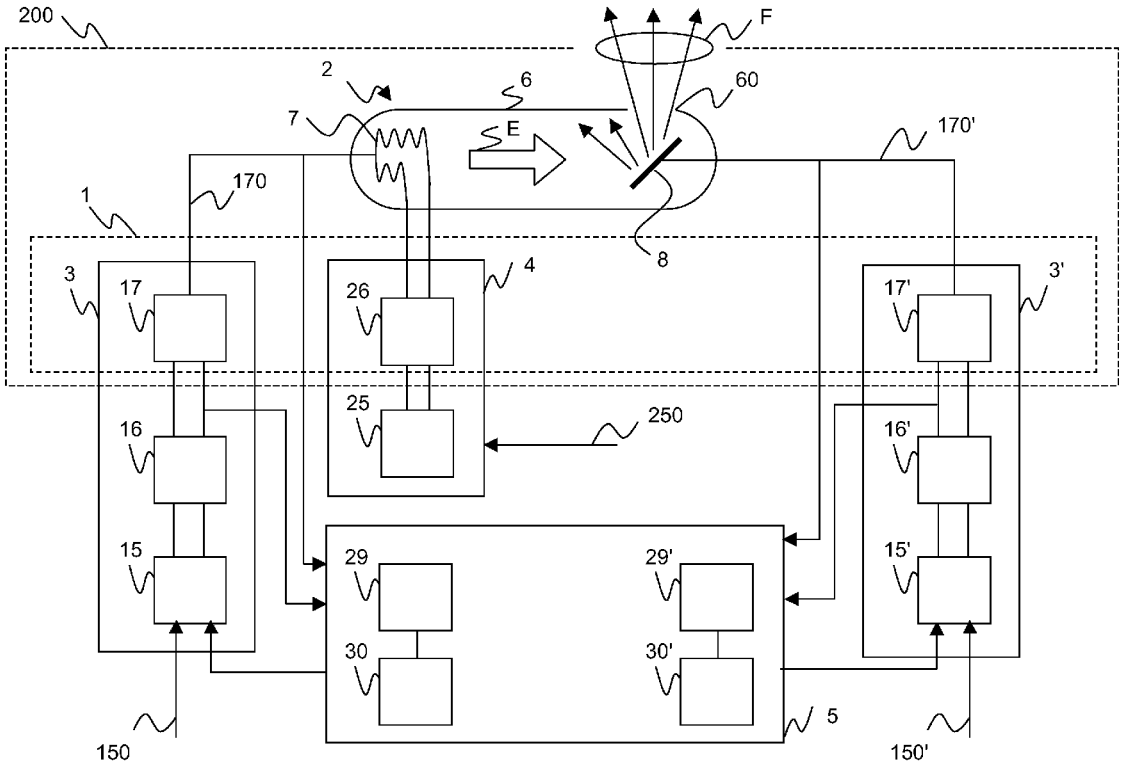
FIG. 7 shows in schematic form a block diagram of a second example of an X-ray machine.

FIG. 7 shows schematically a block diagram of a second example of an X-ray machine.

The X-ray machine 200 according to FIG. 7 has a structure substantially similar to that of FIG. 1. It in fact comprises an X-ray tube 2, a generator 1 and a regulating unit 5. However, unlike the machine 100 shown in FIG. 1, the generator 1 of the machine 200 comprises, in addition to the first power supply circuit 3 and the second power supply circuit 4, a third power supply circuit 3'.

This third power supply circuit 3' is similar to the first power supply circuit 3, namely comprises a third switching power supplier 15', an operating transformer 16' and a positive voltage multiplier 17' connected in cascade. An input 150' of the third switching power supplier 15' is connected to an electric power source, for example the electric mains (not shown in FIG. 1). An output 170' of the positive voltage multiplier 17 is connected to the anode 8.

Therefore, in this example, the anode is not connected to earth, but receives from the third power supply circuit 3' (in particular from an output 170' of the positive voltage multiplier 17') a positive polarisation voltage Vpol'. Therefore, in the X-ray machine 200 shown in FIG. 7, the voltage difference between the cathode 7 and the anode 8 is Vpol-Vpol'. As a result, it is possible to obtain voltage differences greater than those of the machine 100 according to FIG. 1 and therefore also X-ray beams F with a higher power, up to about 450 kV.

Correspondingly, in FIG. 7 it can be seen that the regulating unit 5 of the machine 200 comprises two sensor devices 29, 29' in which the first sensor device 29 detects the negative polarisation voltage Vpol, while the second sensor device 29' detects the positive polarisation voltage Vpol'. Moreover, the regulating unit 5 of the machine 200 comprises two control circuits 30, 30' able to control, respectively, the first switching power supplier 15 and the third switching power supplier 15' for regulating the negative and positive supply voltage, respectively.

Figure 8:
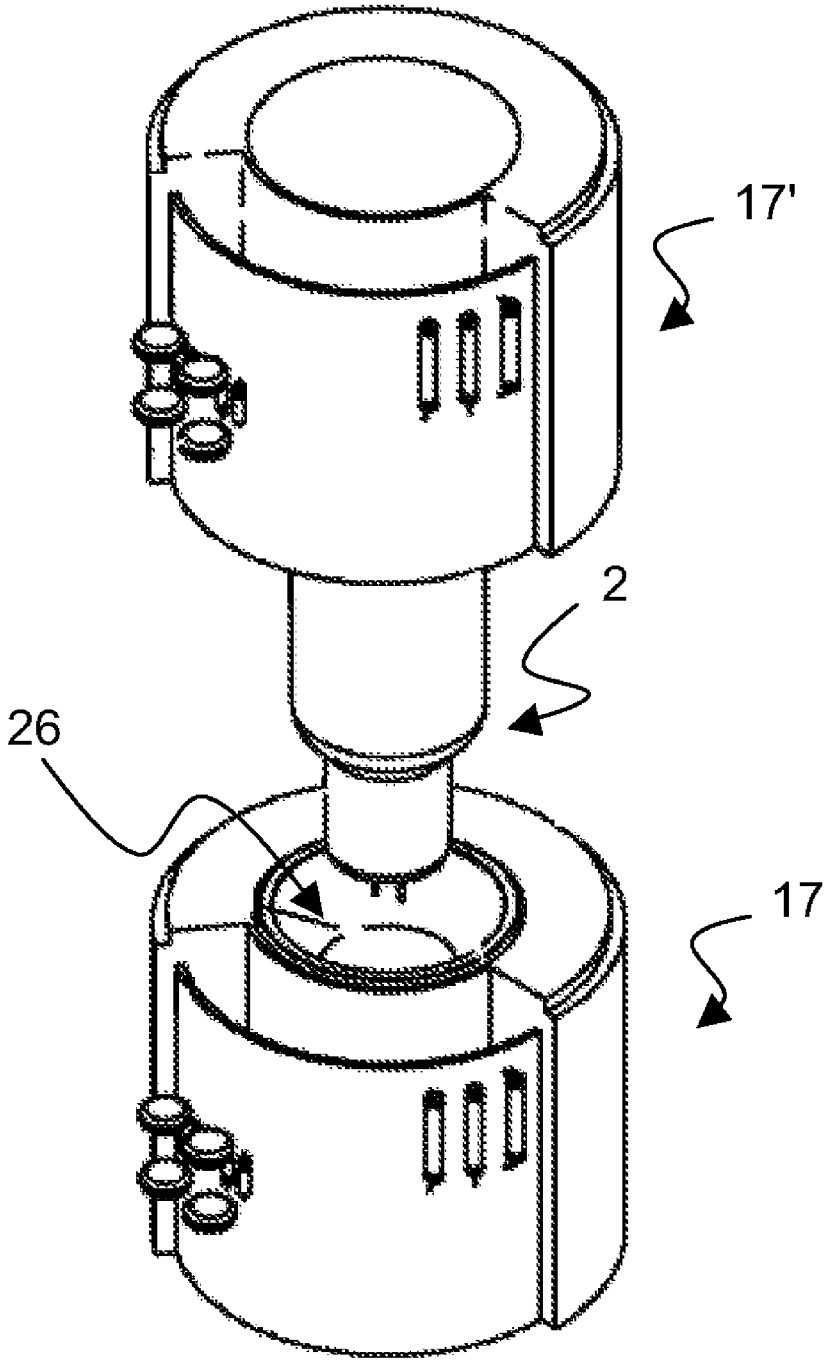
FIG. 8 is a perspective view of an X-ray tube, the filament transformer according to FIGS. 2, 3 and 4 and the voltage multiplier according to FIG. 5 assembled in an operative configuration so as to form part of the X-ray machine according to FIG. 7.

FIG. 8 is a perspective view of an X-ray tube, the filament transformer 26, the negative voltage multiplier 17 and the positive voltage multiplier 17' which are assembled in the operative configuration so as to form part of the X-ray machine according to FIG. 7.

It is assumed that the filament transformer 26 has the structure shown in FIGS. 2, 3 and 4 and that both the negative voltage multiplier 17 and the positive voltage multiplier 17' have the structure shown in FIG. 5.

As shown in FIG. 7, the filament transformer 26, the structure of which was described in detail with reference to FIGS. 2, 3 and 4, is housed in the through-cavity 53 of the support structure 51 of the negative voltage multiplier 17. The X-ray tube 2 is then fixed, by means of the electrical fastening and connection means 46 of the cover 43 described with reference to FIG. 2, to the multiplier 17, said X-ray tube therefore projecting in the axial direction from the through-hole 53 of the negative voltage multiplier 17.

The opposite end of the X-ray tube 2 is housed inside the through-cavity of the positive voltage multiplier 17'.

Moreover, by means of an electrical connection not shown, the negative voltage multiplier 17 is connected to a connection pin 47 of the X-ray tube 2 so as to supply to the cathode 7 of the X-ray tube 2 the negative polarisation voltage Vpol (connection 170 shown in FIG. 7). Similarly, by means of an electrical connection not shown, the positive voltage multiplier 17' is connected to the metal body of the anode of the X-ray tube 2 so as to supply to the anode 8 the positive polarisation voltage Vpol' (connection 170' shown in FIG. 7).

Therefore, advantageously, in this case also, according to the present invention, the negative voltage multiplier 17, the positive voltage multiplier 17', the filament transformer 26 and the X-ray tube 2 form an extremely compact unit which allows the overall dimensions of the generator 1 to be reduced considerably.

Owing to the compactness of the generator 1 shown in the above Figures, this generator may be advantageously used both in X-ray machines where the X-ray tube 2 and the generator 1 are located inside separate metal containers and in X-ray machines with a "single-piece" structure.

According to an embodiment, the cathode 7 (FIGS. 1 and 7) comprises two filaments and a switching mechanism is provided for energising alternately either one. In this way, the X-ray tube has two focuses. Switching is preferably performed at the output of a coil which creates the voltage of the focuses in the cathode. In this way two voltage levels are obtained. By way of example, the first voltage level may be about 4 V and the second voltage level may be about 6 V.

This solution, advantageously, has obvious advantages in terms of dimensions also and in particular when the solution is compared with the prior art in which two separate bulky filament transformers were provided.

One possible implementation of the switching mechanism envisages the use of a microswitch, an electric magnet and an insulating wire guided inside a sheath.

Advantageously, according to a particularly preferred embodiment of the present invention, the sheath is made of optical fibre or the like and is connected to a luminous display element of the LED type. In this way it is possible to verify the state of the switch, i.e. whether it is at the first voltage level or second voltage level.

I claim:

1. A voltage generator for an X-ray machine comprising an X-ray tube with a cathode and an anode;

a negative voltage multiplier for supplying a polarisation voltage to the X-ray tube having a substantially tubular form and an outer wall lined with a layer of insulating material and wherein said negative voltage multiplier has a plurality of resistive elements and a plurality of capacitors, said plurality of resistive elements and said plurality of capacitors are fixed to said outer wall and are substantially embedded in said layer of insulating material; and a filament transformer which can be connected to the X-ray tube for supplying an energisation voltage to the X-ray tube;

wherein said negative voltage multiplier forms a first axial cavity and said first cavity houses said filament transformer.

2. The voltage generator of claim 1, wherein said negative voltage multiplier is formed by a curved sheet of dielectric material.

3. The voltage generator of claim 2, wherein said filament transformer comprises a ferromagnetic core with an elongated form having a straight longitudinal axis.

4. The voltage generator of claim 3, wherein said filament transformer comprises a first casing having a second cavity open at a first end and closed at a second end, wherein said second cavity houses said core.

5. The voltage generator of claim 4, wherein said first casing is made of a dielectric material with an electrical insulation value greater than or equal to 20 kV per mm of thickness.

6. The voltage generator of claim 4, wherein said casing defines a first annular seat at the first end of the second cavity and a second annular seat at the second end of the second cavity, wherein said first and second annular seats are coaxial with said second cavity, wherein said first annular seat houses a primary winding and wherein said second annular seat houses a secondary winding.

7. The voltage generator of claim 6, wherein said second annular seat is arranged so that said secondary winding is situated at a distance from the end of the first casing.

8. The voltage generator of claim 4, wherein a closed bottom of said second cavity and an external wall of said first casing define a substantially cylindrical third cavity.

9. The voltage generator of claim 8, wherein it further comprises a cover which is inserted into the first casing so as to cover said second annular seat.

10. The voltage generator of claim 9, wherein said cover has a cylindrical shank inserted precisely inside the substantially cylindrical third cavity, and a ring with a diameter greater than the diameter of said cylindrical shank.

* * * * *